US012416441B2

(12) United States Patent
Shirata et al.

(10) Patent No.: US 12,416,441 B2
(45) Date of Patent: Sep. 16, 2025

(54) COLD STORAGE

(71) Applicant: PHC Holdings Corporation, Tokyo (JP)

(72) Inventors: Mitsuyuki Shirata, Ehime (JP); Naoki Yanagihara, Gunma (JP)

(73) Assignee: PHC Holdings Corporation, Tokyo (JP)

( * ) Notice: Subject to any disclaimer, the term of this patent is extended or adjusted under 35 U.S.C. 154(b) by 175 days.

(21) Appl. No.: 18/365,733

(22) Filed: Aug. 4, 2023

(65) Prior Publication Data

US 2024/0019192 A1 Jan. 18, 2024

Related U.S. Application Data

(63) Continuation of application No. PCT/JP2022/004485, filed on Feb. 4, 2022.

(30) Foreign Application Priority Data

Mar. 17, 2021 (JP) ..... 2021-043838

(51) Int. Cl.
*F25D 21/08* (2006.01)
*F25B 13/00* (2006.01)

(52) U.S. Cl.
CPC ..... *F25D 21/08* (2013.01); *F25B 13/00* (2013.01)

(58) Field of Classification Search
CPC ..... A47F 3/0426; F25B 13/00; F25D 21/006; F25D 21/08; F25D 23/006; F25D 23/021; F25D 2700/12
See application file for complete search history.

(56) References Cited

U.S. PATENT DOCUMENTS 4,977,754 A * 12/1990 Upton ..... A47F 3/0408 62/277
6,550,261 B1 * 4/2003 Shima ..... F25D 21/04 219/385

(Continued)

FOREIGN PATENT DOCUMENTS

AU 4743299 A1 3/2000
JP 02-277411 A 11/1990

(Continued)

OTHER PUBLICATIONS

European Office Action dated Jan. 13, 2025 issued in the corresponding European Patent Application No. 22770930.0.

(Continued)

*Primary Examiner* — Henry T Crenshaw
(74) *Attorney, Agent, or Firm* — Rimon P.C.

(57) ABSTRACT

A cold storage includes a box including a cold storage chamber, a sliding door that opens and closes the cold storage chamber, and a machine chamber; a compressor disposed in the machine chamber and constituting a refrigeration circuit that cools the inside of the cold storage chamber; a fan that generates an airflow passing around the compressor and blown to the sliding door through an air outlet opened to the machine chamber; a heater disposed in the cold storage chamber; and a control apparatus that operates the heater when a condition of a set temperature for the cold storage chamber being equal to or lower than a specified temperature and a condition of the compressor being in an operating state are satisfied.

6 Claims, 7 Drawing Sheets

(56) References Cited

U.S. PATENT DOCUMENTS

| | | | | |
|---|---|---|---|---|
| 2011/0214444 | A1* | 9/2011 | Yoshii | F25B 47/006<br>62/160 |
| 2022/0170687 | A1 | 6/2022 | Tsukui et al. | |

FOREIGN PATENT DOCUMENTS

| | | | |
|---|---|---|---|
| JP | 2000-088438 | A | 3/2000 |
| JP | 2001-174119 | A | 6/2001 |
| JP | 3190793 | B2 | 7/2001 |
| JP | 2001-245759 | A | 9/2001 |
| JP | 2001-174119 | * | 12/2001 |
| JP | 2005-164199 | A | 6/2005 |
| JP | 2017-020745 | A | 1/2017 |
| WO | 2021/039446 | A1 | 3/2021 |

OTHER PUBLICATIONS

Extended European Search Report dated Apr. 30, 2024 from corresponding EP Application No. 22770930.0, 8 pages.

International Search Report dated Mar. 8, 2022 issued in International Patent Application No. PCT/JP2022/004485, with English translation.

* cited by examiner

COLD STORAGE

CROSS-REFERENCE OF RELATED APPLICATIONS

This application is a Continuation of International Patent Application No. PCT/JP2022/004485, filed on Feb. 4, 2022, which in turn claims the benefit of Japanese Patent Application No. 2021-043838, filed on Mar. 17, 2021, the entire disclosures of which Applications are incorporated by reference herein.

TECHNICAL FIELD

The present disclosure relates to a cold storage.

BACKGROUND ART

Patent Literature (PTL) 1 discloses a cooling storage cabinet in which dew condensation on a glass door can be effectively eliminated by utilizing air from a condenser fan.

CITATION LIST

Patent Literature

PTL 1

Japanese Patent Application Laid-Open No. 2000-88438

SUMMARY OF INVENTION

Technical Problem

A cold storage stores pharmaceuticals and so on in a cold storage chamber at a low temperature. Dew condensation generates on a sliding door for opening and closing the cold storage chamber due to a temperature difference between the inside and the outside of the cold storage chamber. There is a possibility that an amount of the dew condensation generated on the sliding door may increase as the temperature in the cold storage chamber becomes lower. Furthermore, the cold storage chamber has been designed to be cooled to an even lower temperature in recent years. Such a trend may lead to a possibility of causing a larger amount of the dew condensation to generate on the sliding door.

An object of the present disclosure is to suppress the generation of the dew condensation in the cold storage.

Solution to Problem

In order to achieve the above mentioned object, a cold storage according to the present disclosure includes: a box including a cold storage chamber, a sliding door that opens and closes the cold storage chamber, and a machine chamber; a compressor disposed in the machine chamber and constituting a refrigeration circuit that cools an inside of the cold storage chamber; a fan that generates an airflow passing around the compressor and blown to the sliding door through an air outlet opened to the machine chamber; a heater disposed in the cold storage chamber; and a control apparatus that operates the heater when a condition of a set temperature for the cold storage chamber being equal to or lower than a specified temperature and a condition of the compressor being in an operating state are satisfied.

Advantageous Effects of Invention

With the cold storage according to the present disclosure, the generation of the dew condensation can be suppressed.

DESCRIPTION OF EMBODIMENTS

Figure 1:
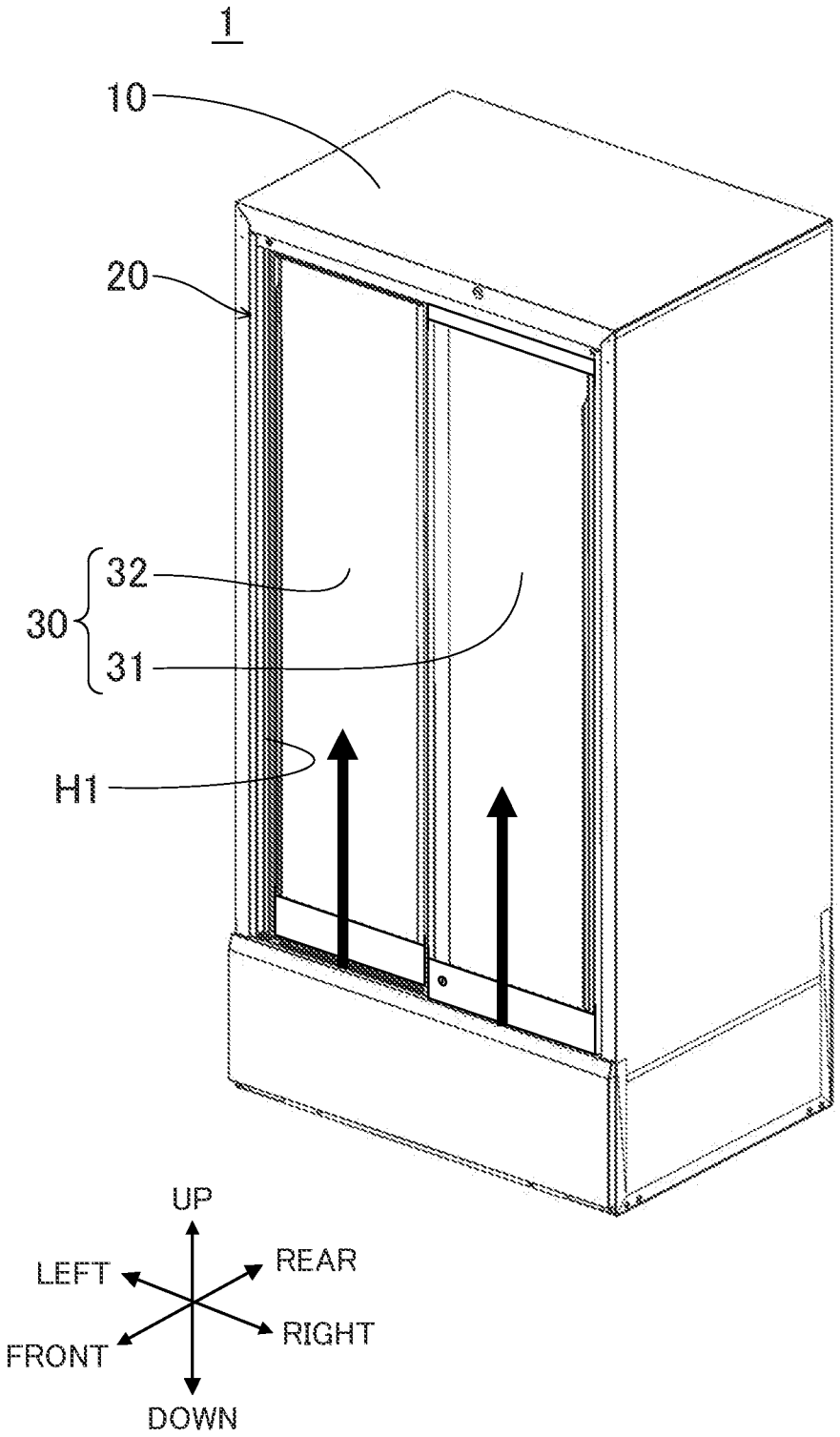
FIG. 1 is a perspective view of a cold storage according to an embodiment of the present disclosure.

An embodiment of a cold storage according to the present disclosure will be described below with reference to the drawings. In the following description, it is assumed that, as denoted by arrows in FIG. 1, a side where sliding door 30 is disposed is a front side with respect to cold storage 1, and a side opposite to the above side is a rear side with respect to cold storage 1. Left and right sides when cold storage 1 is viewed from the front are respectively left and right sides with respect to cold storage 1. A side away from a plane on which cold storage 1 is installed is an upper side with respect to cold storage 1, and a side opposite to the above side is a lower side with respect to cold storage 1.

Cold storage 1 is a pharmaceutical cold storage for storing pharmaceuticals at a low temperature. Cold storage 1 may be a cold storage for blood or a constant temperature container. As illustrated in FIGS. 1 to 4, cold storage 1 includes box 10, frame 20, and sliding door 30.

Figure 3:
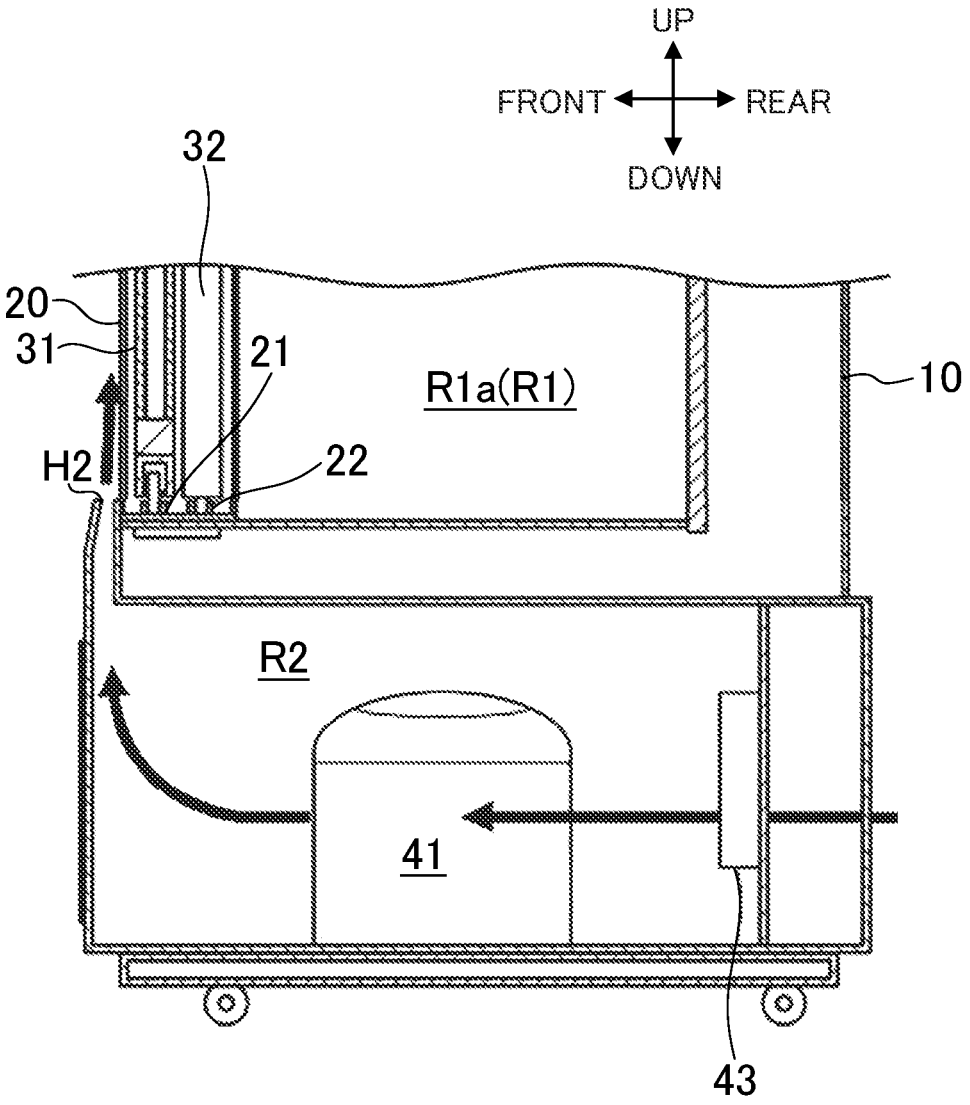
FIG. 3 is a partial vertical sectional view of the cold storage.
Figure 4:
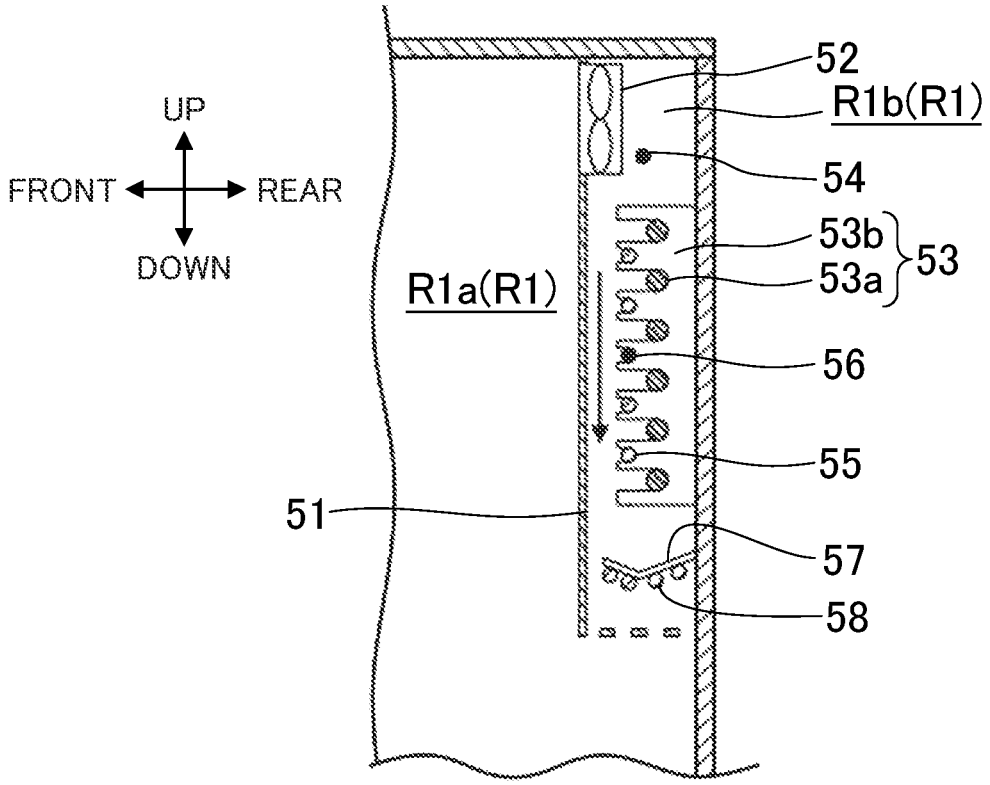
FIG. 4 is a vertical sectional view illustrating a cooling region inside a cold storage chamber.

Box 10 has, in its front surface, opening H1 that provides an entrance opened and closed with movement of sliding door 30. A heat insulating material is filled between an outer surface and an inner surface of box 10. A space surrounded by the inner surface of box 10 serves as cold storage chamber R1, namely a space in which pharmaceuticals are stored (FIGS. 3 and 4).

Frame 20 is attached to box 10 in such a way of bordering opening H1. Frame 20 includes outer rail 21 and inner rail 22 that are disposed on a bottom surface of frame 20 and that extend in a left-right direction. Inner rail 22 is positioned rearward of outer rail 21 (on a side nearer to cold storage chamber R1) (FIG. 3). In addition, sliding door 30 is attached to frame 20.

Sliding door 30 includes first sliding door 31 and second sliding door 32. First sliding door 31 is attached to be movable along outer rail 21. First sliding door 31 is positioned in a right-side region within frame 20 in a closed state. Second sliding door 32 is attached to be movable along inner rail 22. Second sliding door 32 is positioned in a left-side region within frame 20 in a closed state. Opening H1 and hence cold storage chamber R1 are opened and closed with movements of first sliding door 31 and second sliding door 32.

Since first sliding door 31 is disposed on outer rail 21 and second sliding door 32 is disposed on inner rail 22, second sliding door 32 is positioned on a side nearer to cold storage chamber R1 than first sliding door 31. Accordingly, an amount of dew condensation generated on second sliding door 32 is larger than that generated on first sliding door 31.

Figure 2:
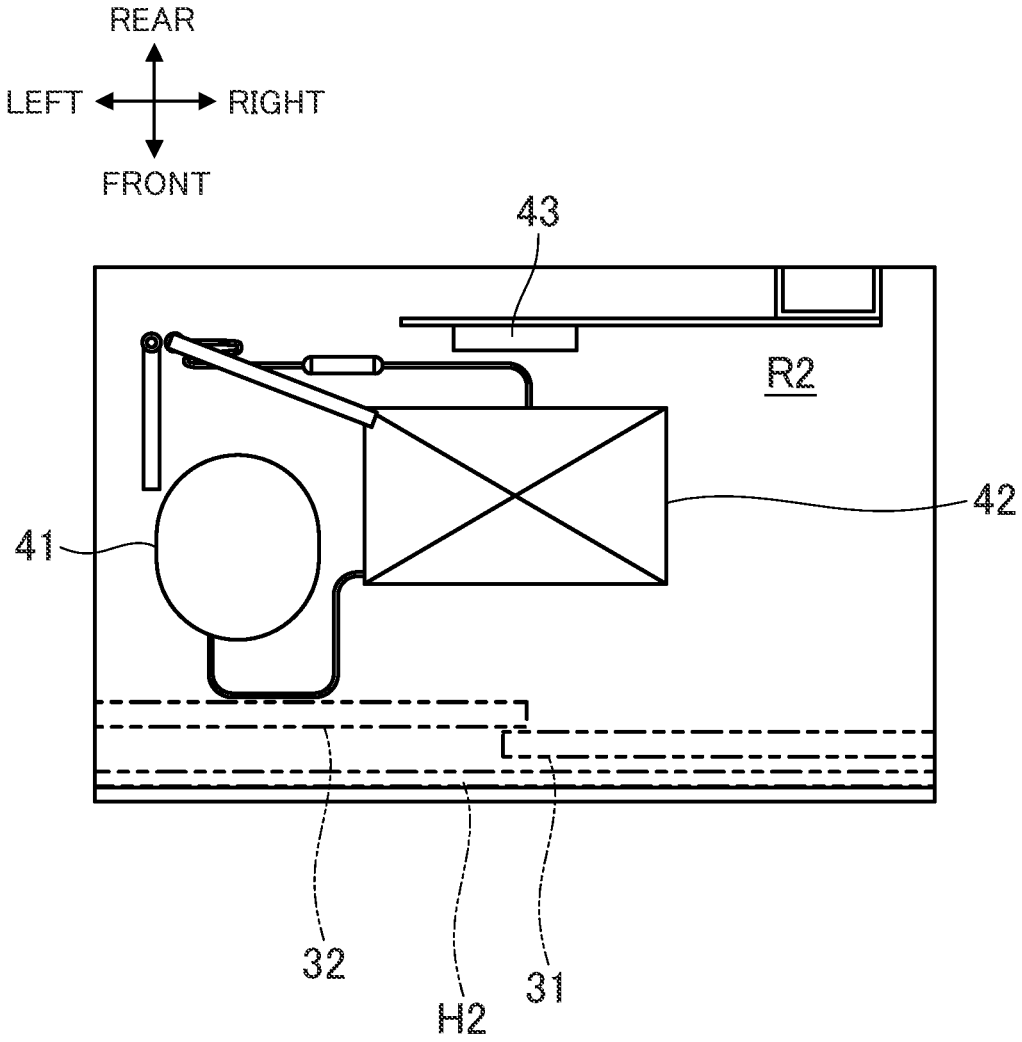
FIG. 2 is a horizontal sectional view illustrating a configuration inside a machine chamber.

Box 10 further includes machine chamber R2 under cold storage chamber R1 (FIGS. 2 and 3).

Machine chamber R2 has air outlet H2. Air outlet H2 is formed to be opened in front of frame 20 such that an airflow (described later) is blown to sliding door 30.

Compressor 41 and condenser 42, both constituting a refrigeration circuit for cooling the inside of cold storage chamber R1, and fan 43 are disposed in machine chamber R2. Compressor 41 is disposed in a left-side region within machine chamber R2. In other words, compressor 41 is disposed at a position nearer to second sliding door 32 in a state of closing cold storage chamber R1 than first sliding door 31 in a state of closing cold storage chamber R1. Condenser 42 is disposed in machine chamber R2 substantially at a center.

Fan 43 generates an airflow. The airflow is denoted by thick arrows in FIGS. 1 and 3. Fan 43 is rotated to take outside air into machine chamber R2 and to generate the airflow. The airflow passes around compressor 41 and condenser 42. When compressor 41 and condenser 42 are in an operating state, the airflow passing around compressor 41 and condenser 42 is warmed by the temperature of compressor 41 and the temperature of condenser 42.

Furthermore, the airflow is blown out through air outlet H2 and is sprayed to sliding door 30. Because the warmed airflow warms sliding door 30, generation of the dew condensation on sliding door 30 is suppressed.

As illustrated in FIG. 4, cold storage chamber R1 is partitioned by sidewall 51 into storage region R1*a* and cooling region R1*b*. Storage region R1*a* is a region where the pharmaceuticals and so on are stored. Cooling region R1*b* is a region where the air in cold storage chamber R1 is cooled.

Second fan 52, evaporator 53 constituting the refrigeration circuit, sensor 54, defrost heater 55, second sensor 56, drain pan 57, and drain pan heater 58 are disposed in an upper end portion of cold storage chamber R1 on the rear side. The surrounding of evaporator 53 serves as cooling region R1*b*. Stated another way, second fan 52, evaporator 53 constituting the refrigeration circuit, sensor 54, defrost heater 55, second sensor 56, drain pan 57, and drain pan heater 58 are disposed in cooling region R1*b*.

Second fan 52 is rotated to take air in storage region R1*a* into cooling region R1*b*. Second fan 52 is disposed in an upper end zone of cooling region R1*b*. Accordingly, second fan 52 takes in air present in an upper zone of storage region R1*a*. The air having been taken into cooling region R1*b* is blown into storage region R1*a* through an opening that is formed at the bottom of cooling region R1*b*. Thus, as indicated by an arrow in FIG. 4, the air having been taken into cooling region R1*b* flows downward from the upper end zone of cooling region R1*b*.

Evaporator 53 cools the air having been taken into cooling region R1*b*. Evaporator 53 is disposed on a lower side than second fan 52. Evaporator 53 includes pipe 53*a* through which a coolant circulating in the refrigeration circuit flows, and fin 53*b* attached to be held in contact with pipe 53*a*.

Sensor 54 detects a temperature in cold storage chamber R1. Sensor 54 is disposed in cooling region R1*b* on an upper side than evaporator 53. In other words, sensor 54 detects a temperature of the air taken into cooling region R1*b* before the taken-in air is cooled by evaporator 53. Thus, the temperature detected by sensor 54 is equal to the temperature in the air in storage region R1*a*.

Defrost heater 55 serves as a heater for, when operated, melting frost adhering to pipe 53*a* and fin 53*b*. Defrost heater 55 is, for example, a sheath heater or a cord heater. Defrost heater 55 is attached at a position away from pipe 53*a* of evaporator 53 while it is held in contact with fin 53*b*. An operation started with activation of defrost heater 55 is especially referred to as a "defrost operation". The defrost operation is performed during a period in which compressor 41 is stopped.

Second sensor 56 is disposed at a position away from pipe 53*a* while it is held in contact with fin 53*b*. Second sensor 56 detects a temperature of fin 53*b*.

Drain pan 57 receives water generated due to the defrost operation. Drain pan 57 is disposed under evaporator 53. The frost adhering to pipe 53*a* and fin 53*b* is melted by the defrost operation, whereby water is generated. The generated water falls down onto drain pan 57 and is drained to machine chamber R2 through a pipe (not illustrated).

Drain pan heater 58 is a heater for heating drain pan 57. Drain pan heater 58 is, for example, a sheath heater or a cord heater. An amount of heat generated by drain pan heater 58 is smaller than that generated by defrost heater 55. Drain pan heater 58 is attached to be held in contact with a rear surface of drain pan 57. There is a possibility that the water received by drain pan 57 may be frozen by being cooled by evaporator 53. Even when the water received by drain pan 57 is frozen and an ice is generated, the ice can be melted with the operation of drain pan heater 58.

Defrost heater 55 and drain pan heater 58 are disposed in cooling region R1*b* as described above. In other words, defrost heater 55 and drain pan heater 58 are disposed in cold storage chamber R1.

Figure 5:
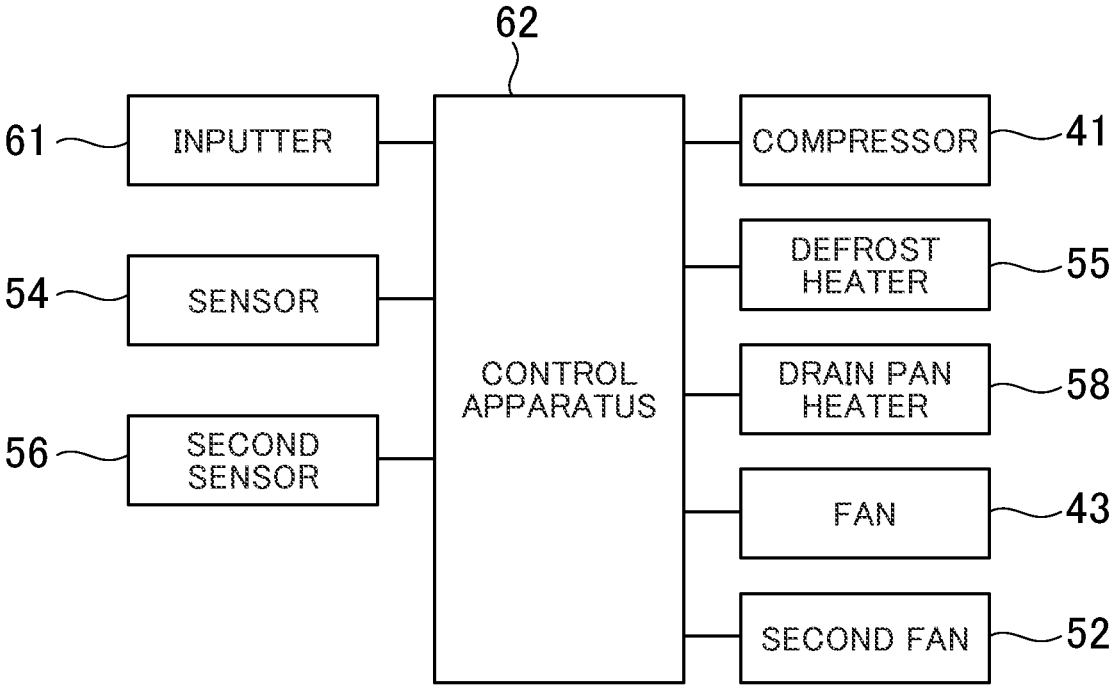
FIG. 5 is a block diagram of the cold storage.

As illustrated in FIG. 5, cold storage 1 further includes inputter 61 and control apparatus 62. Inputter 61 is used to input a set temperature for cold storage chamber R1. Inputter 61 is, for example, a touch panel.

Control apparatus 62 is a computer for supervising and controlling cold storage 1. Control apparatus 62 includes a storage apparatus for storing a computer program (hereinafter simply referred to as a "program") and a processor for executing the computer program.

Inputter 61, sensor 54, second sensor 56, compressor 41, defrost heater 55, drain pan heater 58, fan 43, and second fan 52 are electrically connected to control apparatus 62. Control apparatus 62 obtains the set temperature input through inputter 61, the temperature detected by sensor 54, and the temperature detected by second sensor 56. Control apparatus 62 controls compressor 41, defrost heater 55, drain pan heater 58, fan 43, and second fan 52 based on the set temperature, the temperature detected by sensor 54, and the temperature detected by second sensor 56.

Figure 9:
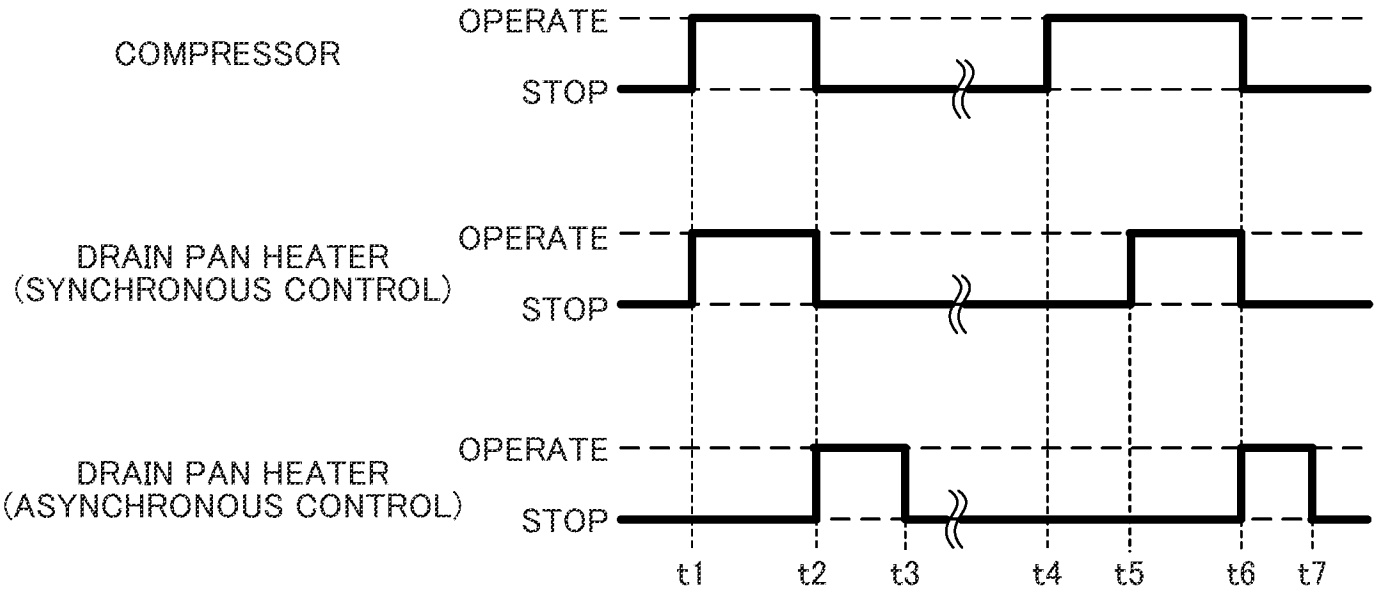
FIG. 9 is a time chart illustrating an operation of a drain pan.

With control apparatus 62 executing the program, compressor 41 is controlled, and hence the temperature in cold storage chamber R1 is controlled to the set temperature. In more detail, control apparatus 62 repeats operation and stop of compressor 41 based on the set temperature and the temperature detected by sensor 54 (FIG. 9). When the program is executed, fan 43 and second fan 52 are controlled to rotate continuously.

The operation of drain pan heater 58, realized with control apparatus 62 executing the program, will be described below with reference to flowcharts of FIGS. 6 to 8. At the start time of the program, drain pan heater 58 is not operated. Furthermore, when the program is executed, the operation and the stop of Compressor 41 are repeated.

Figure 6:
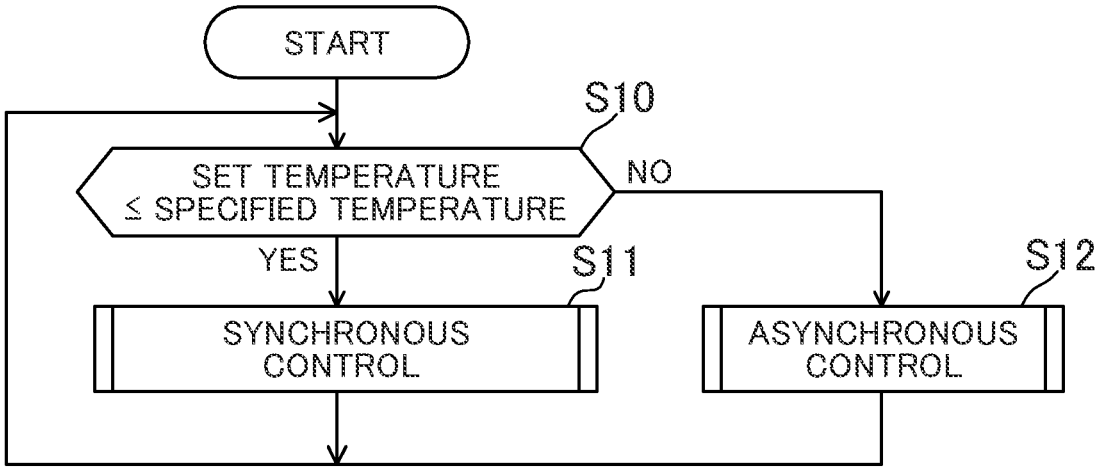
FIG. 6 is a flowchart of a program executed by a control apparatus.

In S10 illustrated in FIG. 6, control apparatus 62 determines whether or not the set temperature obtained from inputter 61 is equal to or lower than a specified temperature. The specified temperature is given as, for example, 3° C., taking into consideration that the amount of the dew condensation generated on sliding door 30 increases relatively when the temperature in cold storage chamber R1 reaches the specified temperature. The specified temperature is previously set in the program executed by control apparatus 62 in a manufacturing stage of cold storage 1. If the set temperature is equal to or lower than the specified temperature (S10: YES), control apparatus 62 executes synchronous control (described later) in S11.

On the other hand, if the set temperature is higher than the specified temperature (S10: NO), control apparatus 62 executes asynchronous control (described later) in S12.

Figure 7:
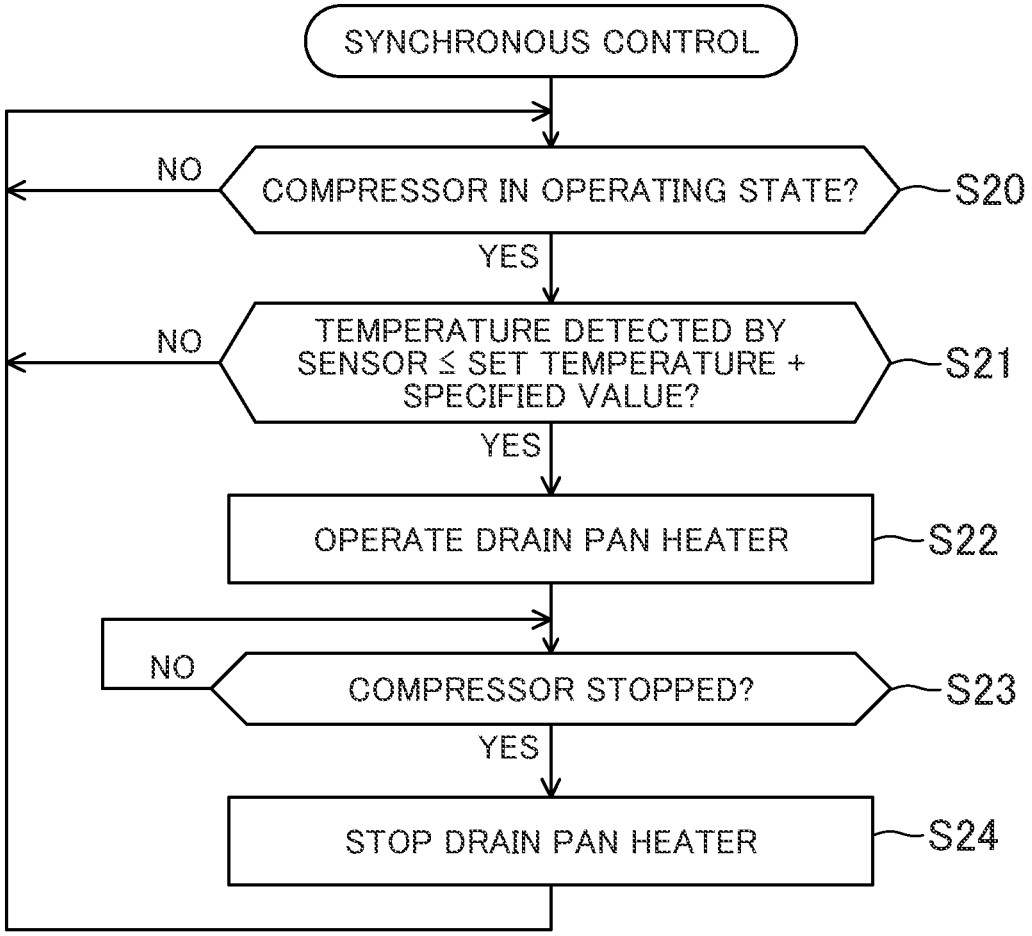
FIG. 7 is a flowchart of a program executed by the control apparatus.

The case in which the synchronous control, illustrated in FIG. 7, is executed will be described below. In the synchronous control, drain pan heater 58 is operated when compressor 41 is operated.

In S20, control apparatus 62 determines whether or not compressor 41 is in the operating state. If compressor 41 is stopped (S20: NO), control apparatus 62 repeatedly executes S20.

On the other hand, if compressor 41 is in the operating state (S20: YES), control apparatus 62 determines in S21 whether or not the temperature detected by sensor 54 is equal to or lower than a temperature (hereinafter referred to as a "sum temperature") resulting from adding a specified value to the set temperature. The specified value is a value at which, regardless of the set temperature being any temperature, the amount of the dew condensation generated on sliding door 30 decreases relatively when the temperature in cold storage chamber R1 reaches the sum temperature. The specified value is a constant value irrespective of the set temperature and is previously set in the program executed by control apparatus 62 in the manufacturing stage of cold storage 1. The specified value is, for example, 5.

If the temperature in cold storage chamber R1 is relatively higher than the set temperature and hence the temperature detected by sensor 54 is higher than the sum temperature (S21: NO), control apparatus 62 returns the program to S20 without operating drain pan heater 58.

On the other hand, if, because of compressor 41 being in the operating state, the temperature in cold storage chamber R1 drops and the temperature detected by sensor 54 becomes equal to or lower than the sum temperature (S21: YES), control apparatus 62 operates drain pan heater 58 in S22.

Then, control apparatus 62 determines in S23 whether or not compressor 41 is stopped. If the temperature in cold storage chamber R1 does not reach the set temperature and hence compressor 41 remains in the operating state (S23: NO), control apparatus 62 repeatedly executes S23.

On the other hand, if the temperature in cold storage chamber R1 reaches the set temperature and hence compressor 41 is stopped (S23: YES), control apparatus 62 stops drain pan heater 58 in S24 and returns the program to S20.

Figure 8:
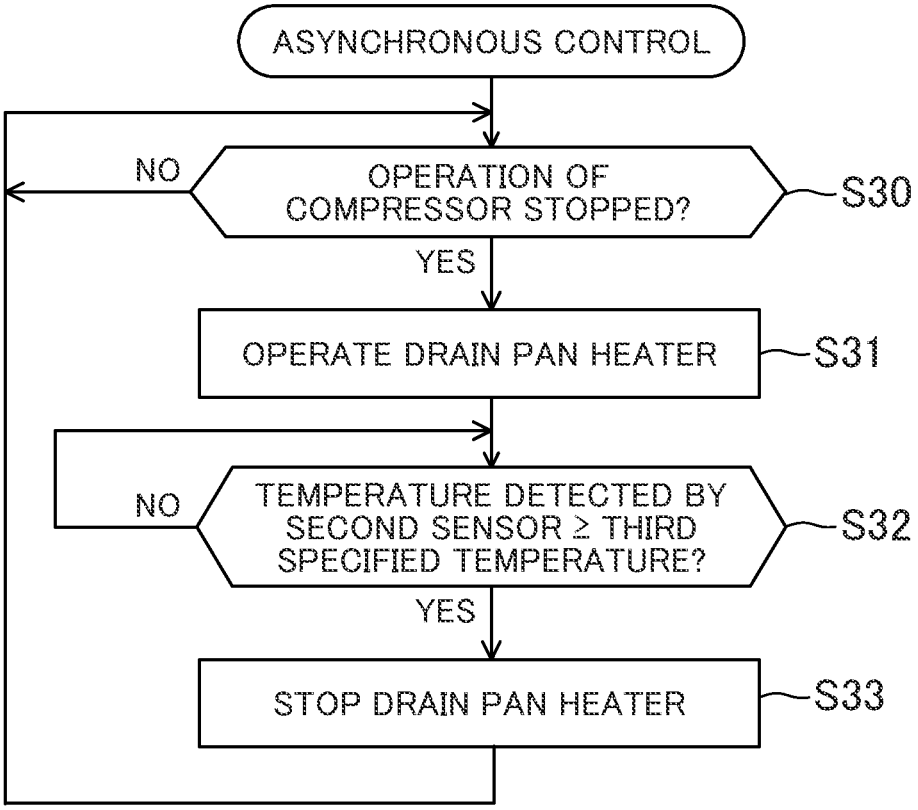
FIG. 8 is a flowchart of a program executed by the control apparatus.

The case in which the asynchronous control, illustrated in FIG. 8, is executed will be described below. In the asynchronous control, the operation of compressor 41 and the operation of drain pan heater 58 are not in synchronism with each other.

In S30, control apparatus 62 determines whether or not the operating state of compressor 41 is stopped. If the operating state of compressor 41 is continued (S30: NO), control apparatus 62 repeatedly executes S30.

On the other hand, if the temperature in cold storage 1 reaches the set temperature and hence the operation of compressor 41 is stopped (S30: YES), control apparatus 62 operates drain pan heater 58 and starts the defrost operation, more specifically, the operation of defrost heater 55 in S31. The defrost operation is continued until the temperature detected by second sensor 56 reaches a second specified temperature.

Then, control apparatus 62 determines in S32 whether or not the temperature detected by second sensor 56 is equal to or higher than a third specified temperature. The third specified temperature is a threshold set to stop the operation of drain pan heater 58. The third specified temperature is higher than the second specified temperature. The second specified temperature and the third specified temperature are previously set in the program executed by control apparatus 62 in the manufacturing stage of cold storage 1.

If the temperature detected by second sensor 56 is lower than the third specified temperature (S32: NO), control apparatus 62 repeatedly executes S32.

If the temperature detected by second sensor 56 becomes equal to or higher than the third specified temperature (S32: YES), control apparatus 62 stops drain pan heater 58 in S33 and returns the program to S30.

The temperature in cold storage chamber R1 when the temperature detected by second sensor 56 becomes the third specified temperature is at a level that is sufficiently lower than a temperature at which there is a possibility of adversely affecting the pharmaceuticals and so on stored in cold storage chamber R1.

The operation of cold storage 1 when the synchronous control of drain pan heater 58 is performed will be described below with reference to a time chart of FIG. 9. When the program is executed, fan 43 is continuously rotated, and hence the airflow is blown to sliding door 30 as described above.

If the set temperature is equal to or lower than the specified temperature (S10: YES) and if the temperature detected by sensor 54 is equal to or lower than the sum temperature (S21: YES) at the time when compressor 41 starts the operation (S20: YES) (time t1), drain pan heater 58 is operated (S22).

Because compressor 41 is operated, the air in cold storage chamber R1 is cooled by evaporator 53. On the other hand, because drain pan heater 58 is disposed in cold storage chamber R1, drain pan heater 58 heats the air cooled by evaporator 53. Thus, drain pan heater 58 works to suppress the cooling performed by the refrigeration circuit. Accordingly, when drain pan heater 58 is operated, a time taken for the temperature in cold storage chamber R1 to reach the set temperature is longer than that when drain pan heater 58 is not operated. In other words, an operating time of compressor 41 when drain pan heater 58 is operated is longer than that when drain pan heater 58 is stopped.

As the operating time of compressor 41 increases, the temperature of compressor 41 rises. Due to the rise of the compressor temperature, the temperature of the airflow passing around compressor 41 also rises. In other words, the temperature of the airflow when drain pan heater 58 is operated becomes higher than that when drain pan heater 58 is stopped. Thus, when the set temperature is set to be equal to or lower than the specified temperature at which the amount of the dew condensation generated on sliding door 30 increases relatively, the temperature of the airflow can be raised, and hence the generation of the dew condensation can be suppressed.

As described above, compressor 41 is disposed nearer to second sliding door 32 in the state of closing cold storage chamber R1 than to first sliding door 31 in the state of closing cold storage chamber R1. Accordingly, the temperature of the airflow blown to second sliding door 32 can be made higher than that blown to first sliding door 31. Moreover, as described above, the amount of the dew condensation generated on second sliding door 32 is larger than that generated on first sliding door 31. In other words, the amount of the dew condensation generated on second sliding door 32 can be effectively suppressed depending on the layout position of compressor 41.

When compressor 41 is stopped upon the temperature in cold storage chamber R1 dropping and reaching the set temperature (S23: YES, time t2), drain pan heater 58 is stopped (S24).

Then, if the set temperature is equal to or lower than the specified temperature (S10: YES) and if the temperature detected by sensor 54 is higher than the sum temperature (S21: NO) even at the time when compressor 41 starts the operation (S20: YES) (time t4), drain pan heater 58 is not operated. When the temperature detected by sensor 54 is higher than the sum temperature, the difference between the temperature in cold storage chamber R1 and the set temperature is relatively large. Therefore, drain pan heater 58 is controlled to be not operated with higher priority given to the cooling by the refrigeration circuit.

The case in which the temperature detected by sensor 54 is higher than the sum temperature corresponds to, for example, the case in which the outside air flows into cold storage chamber R1 because of sliding door 30 being opened by a user and the temperature in cold storage chamber R1 rises. Moreover, when the temperature detected by sensor 54 is higher than the sum temperature, the amount of the dew condensation generated on sliding door 30 is relatively small as described above. Accordingly, the generation of the dew condensation can be sufficiently suppressed with the airflow even at the temperature when drain pan heater 58 is not operated.

Then, when the temperature in cold storage chamber R1 drops due to the operation of compressor 41 and the temperature detected by sensor 54 becomes equal to or lower than the sum temperature (S21: YES), drain pan heater 58 is operated (S22, time t5). Moreover, when compressor 41 is stopped upon the temperature in cold storage chamber R1 further dropping and reaching the set temperature (S23: YES, time t6), drain pan heater 58 is stopped (S24).

The operation of cold storage 1 when the asynchronous control of drain pan heater 58 is performed will be described below with reference to the time chart of FIG. 9. When the asynchronous control is performed, fan 43 is continuously rotated, and the airflow is blown to sliding door 30 as in the above-described case.

In the state of the set temperature being higher than the specified temperature (S10: NO), at the time when compressor 41 starts the operation (S30: NO) (time t1), drain pan heater 58 is not operated. Accordingly, the temperature of the airflow blown to sliding door becomes lower than that when drain pan heater 58 is operated. However, when the set temperature is higher than the specified temperature, the amount of the dew condensation generated on sliding door 30 is smaller than that generated on sliding door 30 when the set temperature is equal to or lower than the specified temperature. As a result, the dew condensation generated on sliding door 30 can be sufficiently suppressed.

When the operation of compressor 41 is stopped upon the temperature in cold storage chamber R1 dropping and reaching the set temperature (S30: YES, time t2), drain pan heater 58 is operated (S31). At that time (t2), defrost heater 55 is also operated.

Because compressor 41 is stopped, the temperature of compressor 41 does not rise in spite of drain pan heater 58 being operated. Accordingly, the temperature of the airflow does not rise.

When the temperature detected by second sensor 56 becomes equal to or higher than the third specified temperature due to melting of the frost adhering to fin 53*b* and rising of the temperature of fin 53*b* (S32: YES, time t3), the operation of drain pan heater 58 is stopped (S33).

Then, drain pan heater 58 repeatedly executes processes of starting the operation when the operation of compressor 41 is stopped (time t6) and stopping the operation when the temperature detected by second sensor 56 becomes equal to or higher than the third specified temperature (t7).

The present disclosure is not limited to the above-described embodiment. Modifications obtained by variously modifying the embodiment also fall within the scope of the present disclosure insofar as the modifications do not depart from the gist of the present disclosure.

For example, in the synchronous control, when compressor 41 is in the operating state, drain pan heater 58 may be operated irrespective of the sum temperature. In that case, S21 in the flowchart illustrated in FIG. 7 is not executed. Stated another way, control apparatus 62 operates drain pan heater 58 when a condition of the set temperature in cold storage chamber R1 being equal to or lower than the specified temperature and a condition of compressor 41 being in the operating state are satisfied.

Furthermore, compressor 41 may be disposed at the center of machine chamber R2 or at a position nearer to first sliding door 31 in the state of closing cold storage chamber R1 than second sliding door 32 in the state of closing cold storage chamber R1.

Moreover, in the synchronous control, defrost heater 55 may be operated instead of drain pan heater 58 when compressor 41 is in the operating state.

The disclosure of Japanese Patent Application No. 2021-043838 filed on Mar. 17, 2021 including the specification, claims, drawings and abstract is incorporated herein by reference in its entirety.

INDUSTRIAL APPLICABILITY

The present disclosure can be widely applied to cold storages, such as a cold storage for pharmaceuticals, a cold storage for blood, and a constant temperature container.

REFERENCE SIGNS LIST

1 cold storage
10 box
20 frame
30 sliding door
41 compressor
42 condenser
43 fan
52 second fan
54 sensor

56 second sensor
57 drain pan
58 drain pan heater
H1 opening
H2 air outlet
R1 cold storage chamber
R2 machine chamber

The invention claimed is:

1. A cold storage comprising:

a box including a cold storage chamber, a sliding door that opens and closes the cold storage chamber, and a machine chamber;

a compressor disposed in the machine chamber and constituting a refrigeration circuit that cools an inside of the cold storage chamber;

a fan that generates an airflow passing around the compressor and blown to the sliding door through an air outlet opened to the machine chamber;

a heater disposed in the cold storage chamber;

a sensor that detects a temperature in the cold storage chamber;

one or more memories; and at least one processor each coupled to at least one of the one or more memories and configured to operate the heater when a condition of a set temperature for the cold storage chamber being equal to or lower than a specified temperature, a condition of the compressor being in an operating state, and a temperature detected by the sensor being equal to or lower than a temperature resulting from adding a specified positive value to the set temperature are satisfied.

2. The cold storage according to claim 1, wherein:

the sliding door includes a first sliding door that opens and closes the cold storage chamber, and a second sliding door that opens and closes the cold storage chamber at a position between the cold storage chamber and the first sliding door, and the compressor is disposed at a position nearer to the second sliding door in a state of closing the cold storage chamber than the first sliding door in a state of closing the cold storage chamber.

3. The cold storage according to claim 2, further comprising a drain pan that receives water generated due to a defrost operation, wherein the heater is a drain pan heater that heats the drain pan.

4. The cold storage according to claim 3, further comprising:

a second fan; and an evaporator, wherein the second fan generates a second airflow sequentially passing through the evaporator, the drain pan, and the drain pan heater.

5. The cold storage according to claim 4, wherein:

the cold storage chamber is partitioned by a sidewall into a storage region and a cooling region, the storage region has an opening, the second fan, the evaporator, the drain pan, and the drain pan heater are located inside the cooling region, and the second airflow further sequentially passing through the opening and the cooling region.

6. The cold storage according to claim 5, wherein the cooling region is located above the machine chamber.

* * * * *